United States Patent [19]

Johanson et al.

[11] 4,069,400

[45] Jan. 17, 1978

[54] MODULAR IN-THE-EAR HEARING AID

[75] Inventors: Donald L. Johanson, Wayland; Thomas S. Chan, Somerville, both of Mass.

[73] Assignee: United States Surgical Corporation, New York, N.Y.

[21] Appl. No.: 764,438

[22] Filed: Jan. 31, 1977

[51] Int. Cl.[2] ..... H04R 25/02

[52] U.S. Cl. ..... 179/107 E

[58] Field of Search ..... 179/107 E

*Primary Examiner*—George G. Stellar

*Attorney, Agent, or Firm*—Weingarten, Maxham & Schurgin

[57] ABSTRACT

An in-the-ear hearing aid in which a complete functional instrument is contained within a modular housing of standardized configuration and which is attachable to a custom ear mold for a particular user's ear. The modular housing is anthropometrically configured and is readily attached to and removed from the ear mold for repair and replacement.

6 Claims, 5 Drawing Figures

MODULAR IN-THE-EAR HEARING AID

FIELD OF THE INVENTION

This invention relates to hearing aids and more particularly to an in-the-ear hearing aid having a standardized modular housing containing a complete functional instrument and attachable to a custom ear mold.

BACKGROUND OF THE INVENTION

In-the-ear hearing aids are well known and are of a size and configuration to fit substantially within the ear of a user. One form of such hearing aids includes an ear mold which has been custom fabricated to precisely fit the ear of a user and which also serves to contain the components of the aid. The custom ear mold thus serves as a housing for the instrument with a cover plate usually employed to seal the unit. A disadvantage of such hearing aids employing a custom molded housing is that assembly of the instrument must be performed after fabrication of the ear mold thereby requiring individualized assembly. In addition, any repair or replacement of hearing aid components requires return of the entire hearing aid to a service center. Hearing aids of this type are shown for example in U.S. Pat. Nos. 3,345,737, 3,496,306 and 3,598,928.

In another known in-the-ear hearing aid, a custom ear mold is provided with a cavity which receives a housing containing the hearing aid instrument or the instrument housing is attached to a tip insertable in the ear canal of a user. This type of hearing aid is shown for example in U.S. Pat. Nos. 3,983,336, 3,783,201, 3,209,082, 3,265,819, 3,312,789 and 3,389,232. In this latter type of hearing aid a portion of the instrument can extend outwardly from the ear and may not present a proper cosmetic appearance. In other known hearing aids of this latter type the construction can be cumbersome in terms of ease of assembly and repair.

SUMMARY OF THE INVENTION

In brief, the present invention provides an in-the-ear hearing aid in which the aid is housed as a wholly functional instrument within a modular housing which is readily attached to a custom ear mold. Replacement or repair of the instrument can be accomplished by removal of the modular housing, with a replacement module being installed in the user's ear mold for use while the original instrument is being serviced. Thus, a user need not return the entire hearing aid and therefore be without the instrument in the event of service. Rather, only the modular housing containing the hearing aid components need be removed and replaced with a similar modular unit.

The modular housing is of standard configuration for a left or a right ear within the range of normal ear sizes, and is anthropometrically configured to fit the outer ear in an unobtrusive manner. The housing includes a coupler removably secured thereto for easy attachment to different ear molds. The coupler includes an output tube which is angularly disposed for connection to tubing leading to the exit aperture of the ear mold. By means of the selectively installed coupler a short direct acoustic path is provided without leakage from the receiver to the output aperture.

DESCRIPTION OF THE DRAWINGS

The invention will be more fully understood from the following detailed description taken in conjunction with the accompanying drawings in which.

DETAILED DESCRIPTION OF THE INVENTION

Figure 1:
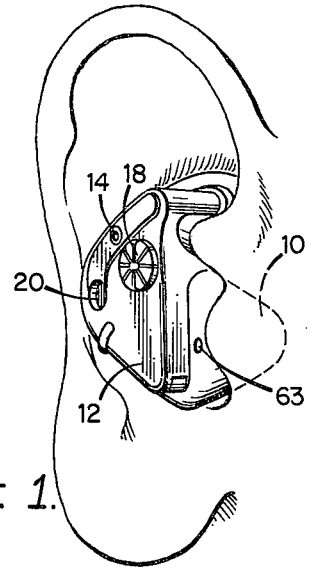
FIG. 1 is a pictorial view of an in-the-ear hearing aid according to the invention.
Figure 2:
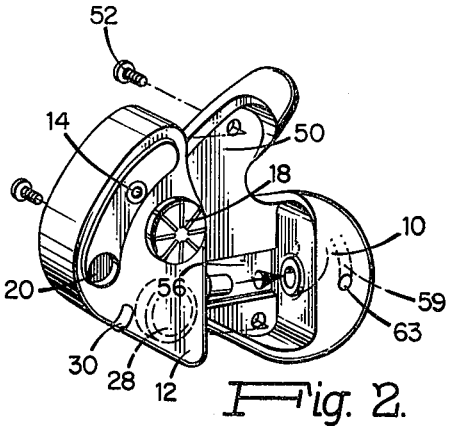
FIG. 2 is an exploded pictorial view of the in-the-ear hearing aid according to the invention.
Figure 3:
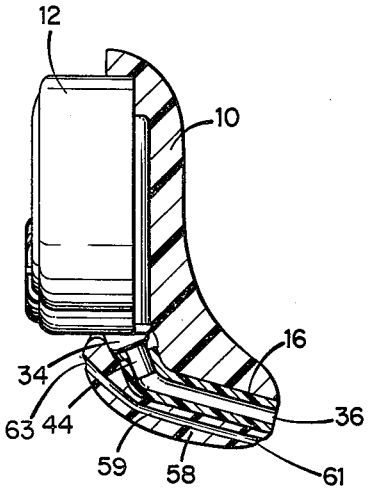
FIG. 3 is a partially cutaway side view illustrating attachment of the modular unit to the custom ear mold.
Figure 4:
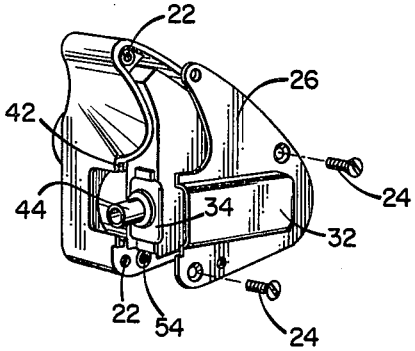
FIG. 4 is an exploded pictorial view of the modular unit.

Referring to FIGS. 1–4 there is shown an in-the-ear hearing aid constructed according to the invention as worn wholly in the ear of a user. An ear mold 10 is formed by well-known molding techniques to precisely fit the ear cavity of a user and into which is removably attached a modular unit 12 containing the components providing a wholly functional hearing aid instrument. The modular unit 12 includes a microphone receiving sound energy by way of a microphone port 14 in the outer wall of the unit housing, a receiver or transducer for converting electrical signals into acoustical energy for conveyance via tubing 16 to the ear of a user, amplifying and processing circuitry, and a battery source. The housing also contains a volume control 18 and a tone control 20 and may contain other controls for adjusting the characteristics of the instrument for intended sound reception. The electronic circuitry and associated transducers can be of any known form and are not per se part of the present invention.

The housing of modular unit 12 is typically formed of a plastic material and includes threaded metal inserts 22 into which are secured machine screws 24 for attachment of a metal bottom plate 26. A battery compartment 28 is hinged by means of one of the machine screws 24 at a corner of housing 12, the battery compartment being pivotable outward for battery replacement by means of a finger tab 30. The bottom plate 26 includes an outwardly extending portion 32 for accommodation of the receiver within housing 12. The receiver is connected to a coupler 34, also shown in FIG. 5, which is removably secured to housing 12 and to which is connected tubing 16 for coupling of the receiver to the exit aperture 36 of the ear mold 10. The coupler 34 includes a plate 38 having a flange 40 around a portion of the periphery thereof, the flange being slidably disposed within a groove 42 provided around the rectangular opening in the wall of housing 12. The coupler is installed with the flange 40 in the cooperating groove 42 and is retained therein by bottom plate 26. An outwardly extending tube 44 of the coupler 34 is connected to the exit aperture 36 of the ear mold by an interconnecting flexible tubing 16 of Tygon or other suitable material. According to the invention different couplers can be installed in housing 12 with the angle of the coupler tube 44 selected to accommodate connection to the exit aperture of the ear mold for a mold of specific configuration.

Figure 5:
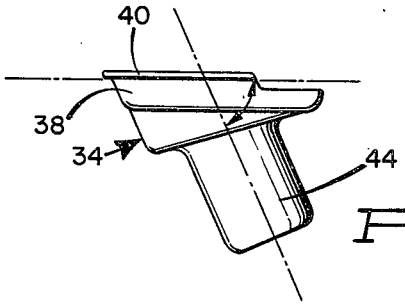
FIG. 5 is a side view of the receiver coupling employed in the invention.

Since the ear mold is formed to fit an individual user's ear, the configuration of the mold can vary to a considerable degree. The angle of tube 44 to the mounting flange 40 of coupler 34, as shown by the arrows in FIG. 5, is selected to join tube 16 at a particular angle suitable for the individual ear mold employed. Different couplers 34 are readily installed in housing 12.

The ear mold 10 is formed of a suitable material typically a plastic such as Lucite and includes a recessed area 50 of shape and size to receive modular unit 12 mounted thereon. The mounting plate 26 of unit 12 is supported by the confronting surface of recessed area 50, and unit 12 is secured to the ear mold by means of machine screws 52 which pass through openings provided in the ear mold and in plate 26 and into threaded sleeves 54 provided in the housing of unit 12. The mounting surface of recessed area 50 is substantially flat and includes an inwardly extending trough portion 56 for accommodation of portion 32 of plate 26. It will be appreciated that the plate 26 can be completely flat if a receiver is employed of sufficiently small size to be wholly contained within the housing of unit 12. The tip portion 58 of the ear mold which fits into the ear canal includes an opening therethrough into which is disposed the coupler 34 and tubing 16. A passage 59 is provided in portion 58 of the ear mold between an opening 61 adjacent aperture 36 and an opening 63 at the exterior of the ear mold to serve as a vent passage in known manner. In one way to assemble the hearing aid for use, tubing 16 is inserted over tube 44 of coupler 34, and the tubing 16 is then installed in the opening of the tip portion 58, seated in area 50 and secured thereto by mounting screws 52. Any excess tubing 16 extending out of the aperture 36 is trimmed flush with the aperture and the instrument is then ready for insertion in a user's ear.

The embodiment illustrated in the drawing is for use with the right ear and it will be appreciated that a left ear version can be similarly constructed with the ear mold 10 and modular unit 12 appropriately configured for the left ear. Thus the invention can be implemented in a right ear model and a left ear model and for each ear the modular unit 12 is of standardized construction to mate with the normal range of custom ear molds for individual users.

The invention is not intended to be limited by what has been particularly shown and described except as indicated in the accompanying claims.

What is claimed is:

1. An in-the-ear hearing aid comprising:

a modular unit contained within a housing of standardized configuration and providing a wholly operable instrument, said housing including:

a mounting plate for attachment of said housing to an ear mold, and a coupler for acoustic connection of the receiver of the hearing aid to the exit aperture of the ear mold, said coupler being removably attached to said housing and having an output tube outwardly extending in predetermined angular relation to said housing;

an ear mold adapted to fit the ear cavity of a user and having a recessed area onto which is secured the mounting plate of said housing for attachment of said housing to said ear mold, and a tip portion adapted to extend into the ear canal of a user and having an opening therethrough terminating in an exit aperture;

means for securing said housing to the recessed area of said ear mold; and a flexible tubing extending through the opening in said tip portion of the ear mold and connected at one end to the output tube of said coupler and terminating at the other end at said exit aperture of the ear mold.

2. The hearing aid of claim 1 wherein said housing includes an opening in a side wall thereof and a mounting configuration around the periphery of said opening; and wherein said coupler includes a plate having a periphery cooperative with the mounting configuration of said opening for removable attachment to said housing.

3. The hearing aid of claim 1 wherein said coupler includes a plate having a flange around the periphery thereof, said output tube being outwardly extending from said plate at a predetermined angle thereto;

said housing having an opening in a wall thereof and a groove provided around the periphery of the opening into which said flange is slidably disposed.

4. The hearing aid of claim 3 wherein said mounting plate includes a portion retaining the plate of said coupler in the groove of said housing with the mounting plate secured to the housing.

5. The hearing aid of claim 1 wherein said ear mold includes a vent opening through the tip portion thereof communicating between an opening adjacent said exit aperture and an opening at the exterior of the ear mold.

6. An in-the-ear hearing aid comprising:

a modular unit contained within a housing of standardized configuration and providing a wholly operable instrument, said housing including:

a plurality of threaded inserts secured in the wall of said housing;

a substantially flat mounting plate threadably secured to said housing and adapted for attachment of said housing to an ear mold, and a coupler for acoustic connection of the receiver of the hearing aid to the exit aperture of the ear mold, said coupler having a peripheral flange for removable attachment within a groove in a portion of the wall of said housing and having an output tube outwardly extending in predetermined angular relation to said housing;

an ear mold adapted to fit the ear cavity of a user and having a substantially flat recessed area onto which is threadably secured the mounting plate of said housing for attachment of said housing to said ear mold, and a tip portion adapted to extend into the ear canal of a user and having an opening therethrough terminating in an exit aperture and a vent opening therethrough communicating with the exterior of said ear mold; and a flexible tubing extending through the opening in the tip portion of said ear mold and connected at one end to the output tube of said coupler, and terminating at the other end at the exit aperture of said ear mold.

* * * * *